US006202967B1

(12) United States Patent
Fraczek

(10) Patent No.: US 6,202,967 B1
(45) Date of Patent: Mar. 20, 2001

(54) ZERO CLEARANCE BRACKET AND HEADRAIL

(75) Inventor: Richard R. Fraczek, Stamford, CT (US)

(73) Assignee: RollEase, Inc., Stamford, CT (US)

( * ) Notice: Subject to any disclaimer, the term of this patent is extended or adjusted under 35 U.S.C. 154(b) by 0 days.

(21) Appl. No.: 09/498,670

(22) Filed: Feb. 7, 2000

Related U.S. Application Data

(60) Provisional application No. 60/140,566, filed on Jun. 23, 1999.

(51) Int. Cl.[7] ..... A47H 1/10

(52) U.S. Cl. ..... 248/261; 160/178.1; 160/902

(58) Field of Search ..... 248/251, 261, 248/273, 342; 160/902, 178.1 R, 38, 39

(56) References Cited

U.S. PATENT DOCUMENTS 3,927,437 * 12/1975 Ford ..... 16/94 R
4,254,813 * 3/1981 Vecchiarelli ..... 160/38 X
5,186,426 * 2/1993 Wada ..... 248/251
6,039,295 * 3/2000 De Beijer ..... 248/262

* cited by examiner

*Primary Examiner*—Ramon O. Ramirez
(74) *Attorney, Agent, or Firm*—Gottlieb, Rackman & Reisman, P.C.

(57) ABSTRACT

An improved bracket and headrail assembly is provided. The bracket is secured to a structure, such as a window casing or ceiling, and comprises a vertical back member and a depending forwardly extending horizontal top leg. The vertical member has a first engagement member for engaging and securing the headrail. The headrail has a front vertical portion that leads to a top end and a depending horizontal member that is designed to underly the top leg of the bracket when assembled. The top horizontal member has a second engagement member that selectively engages the first engaging member of the bracket. The headrail also has a lifting mechanism so that, as the two pieces are assembled, the top of the vertical headrail portion is raised into a substantially flush relationship with the ceiling.

10 Claims, 6 Drawing Sheets

ZERO CLEARANCE BRACKET AND HEADRAIL

This application claim benefit to provisional application 60/140,566 Jun. 23, 1999.

BACKGROUND OF THE INVENTION

This invention relates to a bracket and headrail assembly for window coverings, and more particularly, to a bracket and headrail assembly that provides zero clearance between the headrail and a ceiling or a window casing.

Window coverings typically operate on some type of hardware system that is installed above a window. Typically, that hardware system is installed inside a headrail for a more aesthetically pleasing appearance. The headrail is typically mounted on brackets which are attached to the ceiling or to the casing of a window. The brackets typically engage the top, back or bottom of the headrail. Whenever a headrail is engaged or otherwise coupled to one or more brackets, some clearance above the rail must be provided. This clearance produces a space between the headrail and the window casing or ceiling. This space is not desirable because the brackets remain partially exposed and the integrity of the shade provided by the window covering is compromised.

Currently, several types of brackets are used in the window coverings industry. One type of bracket is installed along the window frame. The headrail with the window covering is hooked onto an arm extending from the bracket, and then, using the hooked part of the bracket as a pivot element, rotated into position until it snaps onto a second arm of the bracket. Another type of bracket allows the rail to slide into position on the horizontal flat surfaces along the top and bottom of the bracket and then lock into position by means of a locking element.

The pivoting-type brackets discussed above are less than desirable since substantial space between their top surface and the headrail is produced. Moreover, this space cannot be easily eliminated because of the nature of the snap-in feature they incorporate. Brackets with a sliding surface, also discussed above, have significantly smaller spaces where light may get through; however, the installation process forces the rail into its top position before it reaches its final, fully installed position, pressing against the ceiling or window casing and scratching the ceiling or window casing as the rail is slid into its final resting position.

Accordingly, it is desirable to provide a bracket and headrail assembly that will hide its brackets and eliminate light leakage at the top of the headrail with an installation process that will not scratch the window casing or ceiling.

SUMMARY OF THE INVENTION

Generally speaking, in accordance with the present invention, an improved bracket and headrail assembly is provided. The bracket is secured to a structure, such as a window casing or ceiling, and comprises a vertical back member and a depending forwardly extending horizontal top leg. The vertical member has a first engagement member for engaging and securing the headrail. The headrail has a front vertical portion that leads to a top end and a depending horizontal member that is designed to underly the top leg of the bracket when assembled. The top horizontal member has a second engagement member that selectively engages the first engagement member of the bracket. The headrail also has a lifting mechanism so that, as the two pieces are assembled (the headrail is pushed back onto the bracket), the top of the vertical headrail portion is raised into a substantially flush relationship with the ceiling.

It is thus an object of the present invention to eliminate any clearance between the headrail and a ceiling or window casing.

It is another object of the present invention to completely hide the brackets of the window coverings from sight.

Still another object of the invention is to eliminate light leakage that normally occurs between the headrail and the structure to which the bracket is attached.

A further object of the invention is to provide a window covering installation process that does not damage or scrape the window casing or ceiling while pressing the headrail up against the window casing or ceiling once fully installed.

BRIEF DESCRIPTION OF THE DRAWINGS

For a fuller understanding of the invention, reference is made to the following description, taken in connection with the accompanying drawings, in which.

DETAILED DESCRIPTION OF THE PREFERRED EMBODIMENTS

Figure 1A:
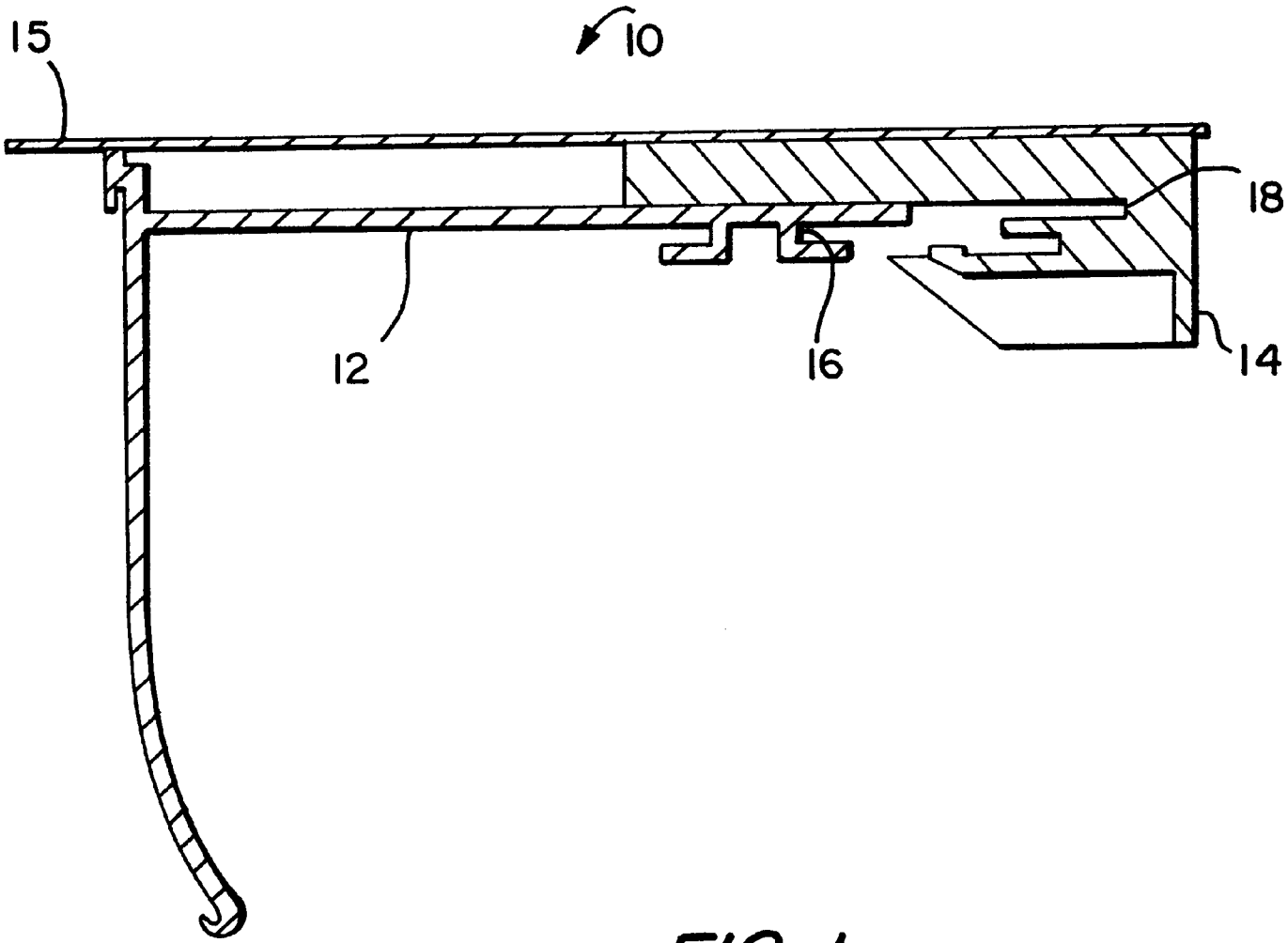
FIG. 1*a* depicts a prior art sliding bracket and headrail partially engaged.
Figure 1B:
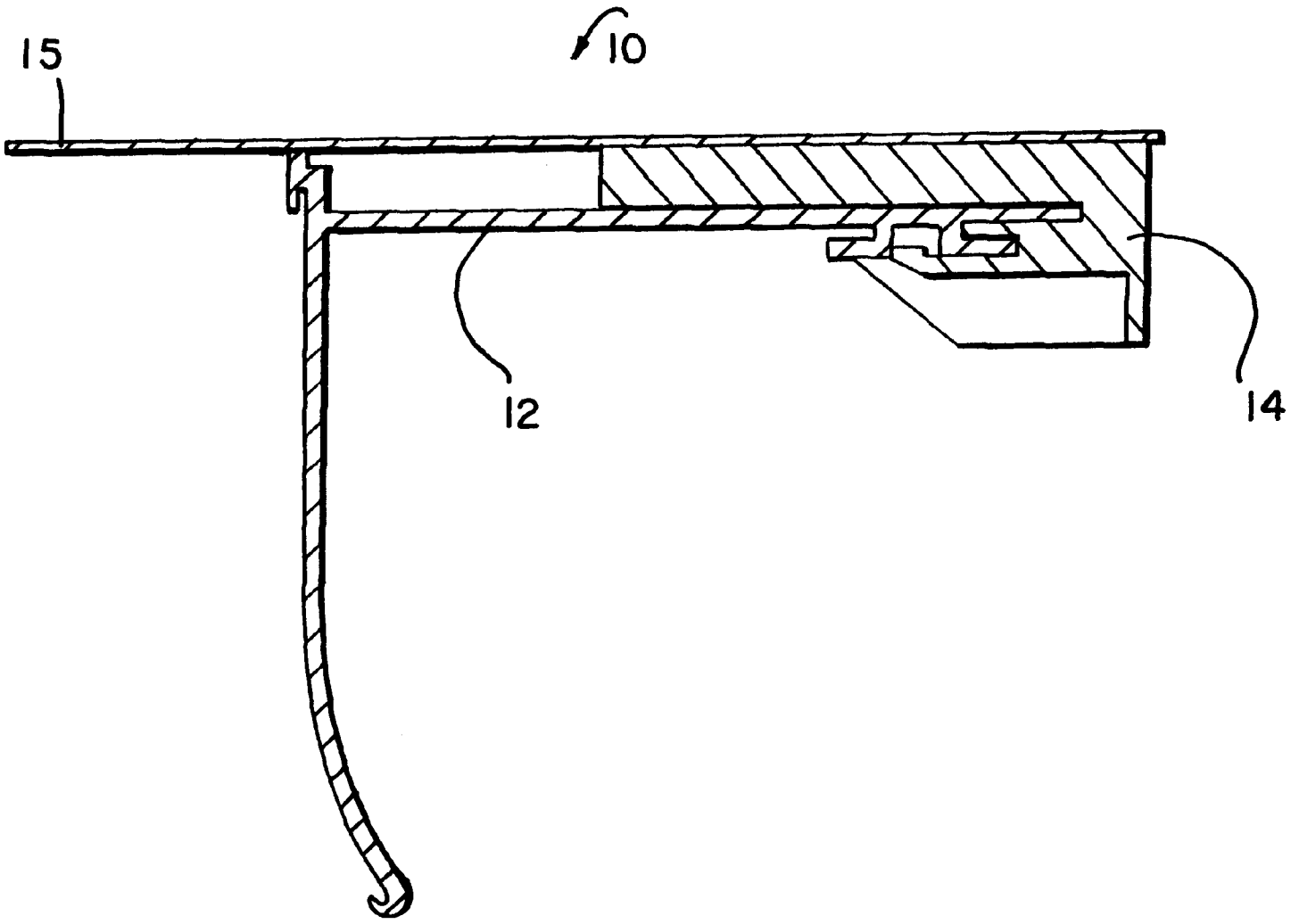
FIG. 1*b* depicts a prior art sliding bracket and headrail fully engaged.

Referring first to FIG. 1*a,* a bracket and headrail assembly generally indicated at 10 and made in accordance with the prior art is shown. Assembly 10 comprises a bracket 14 and headrail 12. In FIG. 1*a,* bracket 14 and headrail 12 are shown partially engaged. Headrail 12 has an engaging member 16 which is slid into a receiving groove 18 on bracket 14. FIG. 1*b* shows bracket 14 and the headrail 12 fully engaged. During engagement of bracket 14 and headrail 12, the top part of headrail 12 will scrape along ceiling 15, scratching and damaging ceiling 15 (not shown).

Figure 2:
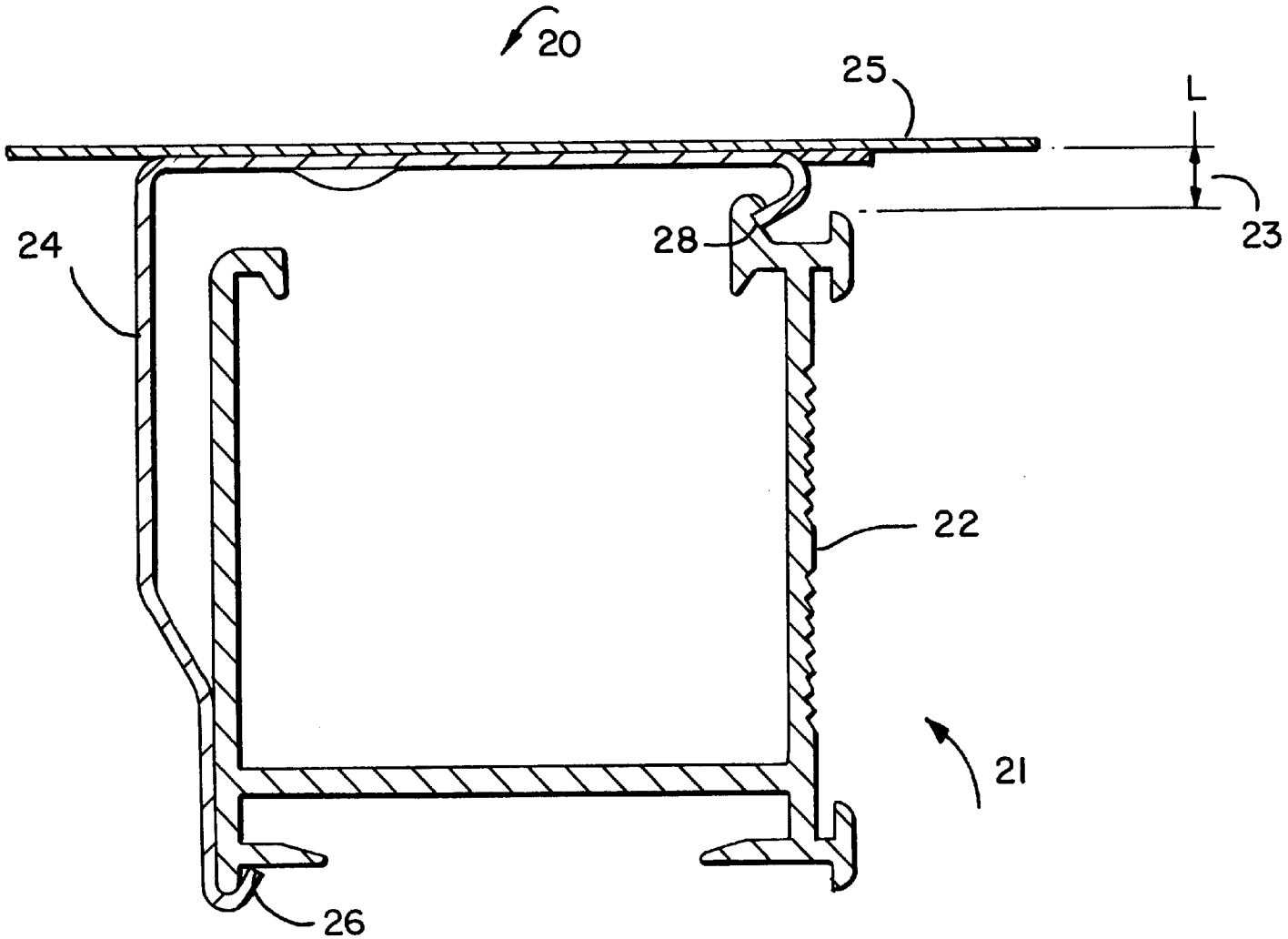
FIG. 2 depicts a prior art "hook" bracket and headrail assembly.

FIG. 2 shows a pivoting bracket and headrail assembly 20 also made in accordance with the prior art and which comprises a bracket 24 and headrail 22. Bracket 24 is fixedly attached to a ceiling 25. Headrail 22 is first set into bracket 24 at one end 26 and then rotated upwardly (see arrow 21) until a hook at other end 28 is secured within the bracket. While the assembly 20 does not damage or scratch ceiling 25, it leaves a substantial space 23 between ceiling 25 and the top of the headrail 22, which, as discussed before, is less than desirable.

Figure 3A:
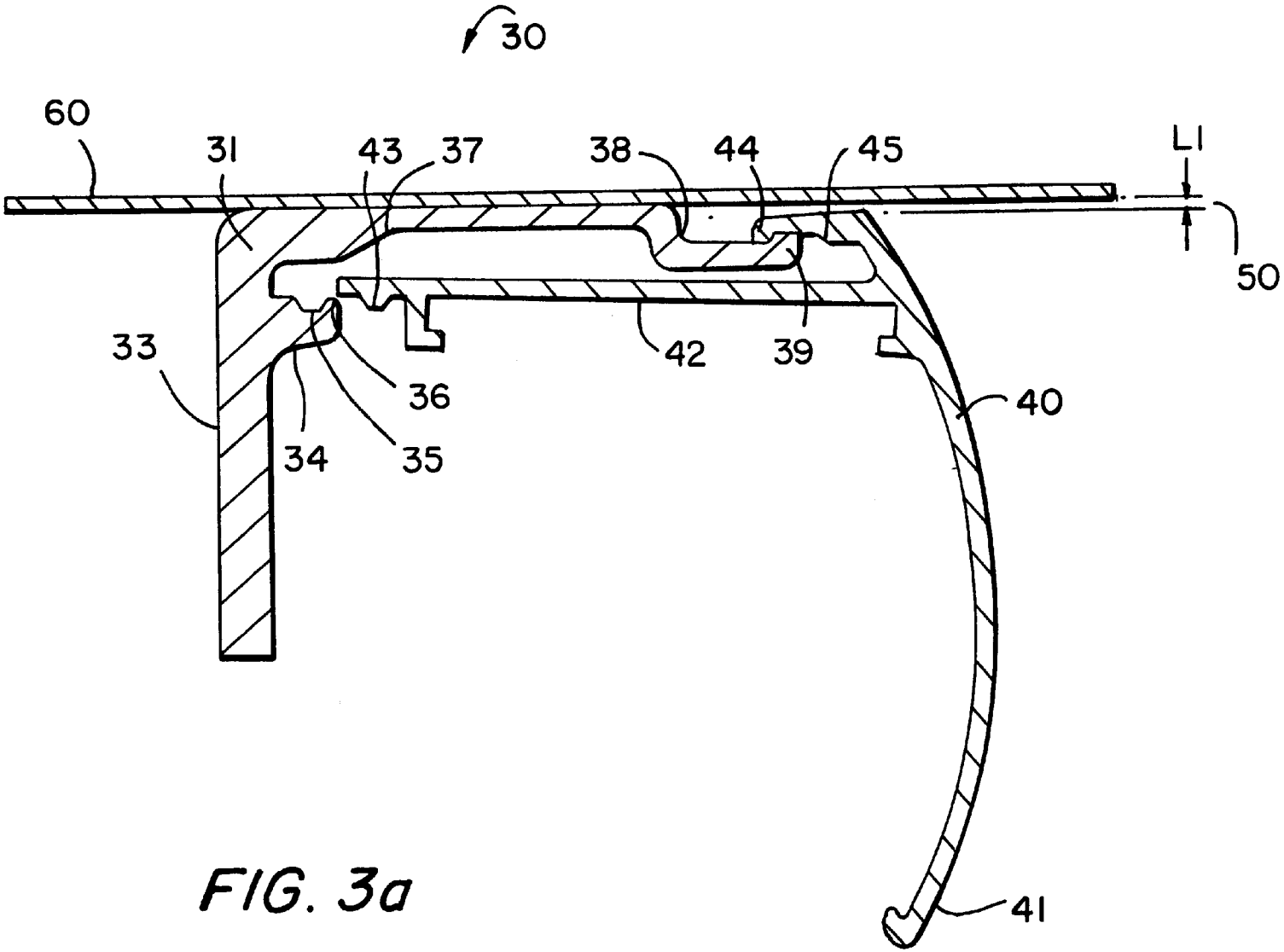
FIG. 3*a* depicts the bracket and headrail of the present invention before assembly.

Turning now to FIG. 3*a,* a bracket and headrail system made in accordance with the principles of the present invention and generally indicated at 30, is described. System 30 comprises a bracket 31 and a headrail 40. Bracket 31 is secured to a ceiling 60 or window casing (not shown) and has a vertical back member 33 with a forwardly extending finger 34. Finger 34 is formed with an upper pocket 35 and upper protruding element 36 at its end. Bracket 31 also has a forwardly extending horizontal leg member 32 formed with a step down lip 38 at its front end leading to a forward nib element.

Headrail 40 has a rearwardly extending horizontal member 42 and a vertically extending partially arcuate shaped front portion 41 formed with a hook element 44 at its top. Hook element 44 defines a ramp 45 on the bottom therealong for facilitating lifting of headrail 40 as ramp 45 slides over nib element 39 formed at the end of leg member 32 of bracket 31. Significantly, horizontal member 42 is formed with a nib 43 on its underside along the rear thereof for rearwardly engaging with pocket 35 of finger 34.

In FIG. 3*a,* headrail 40 is about to engage with bracket 31. In this position, there is a space 50 between headrail 40 and the ceiling.

Figure 3B:
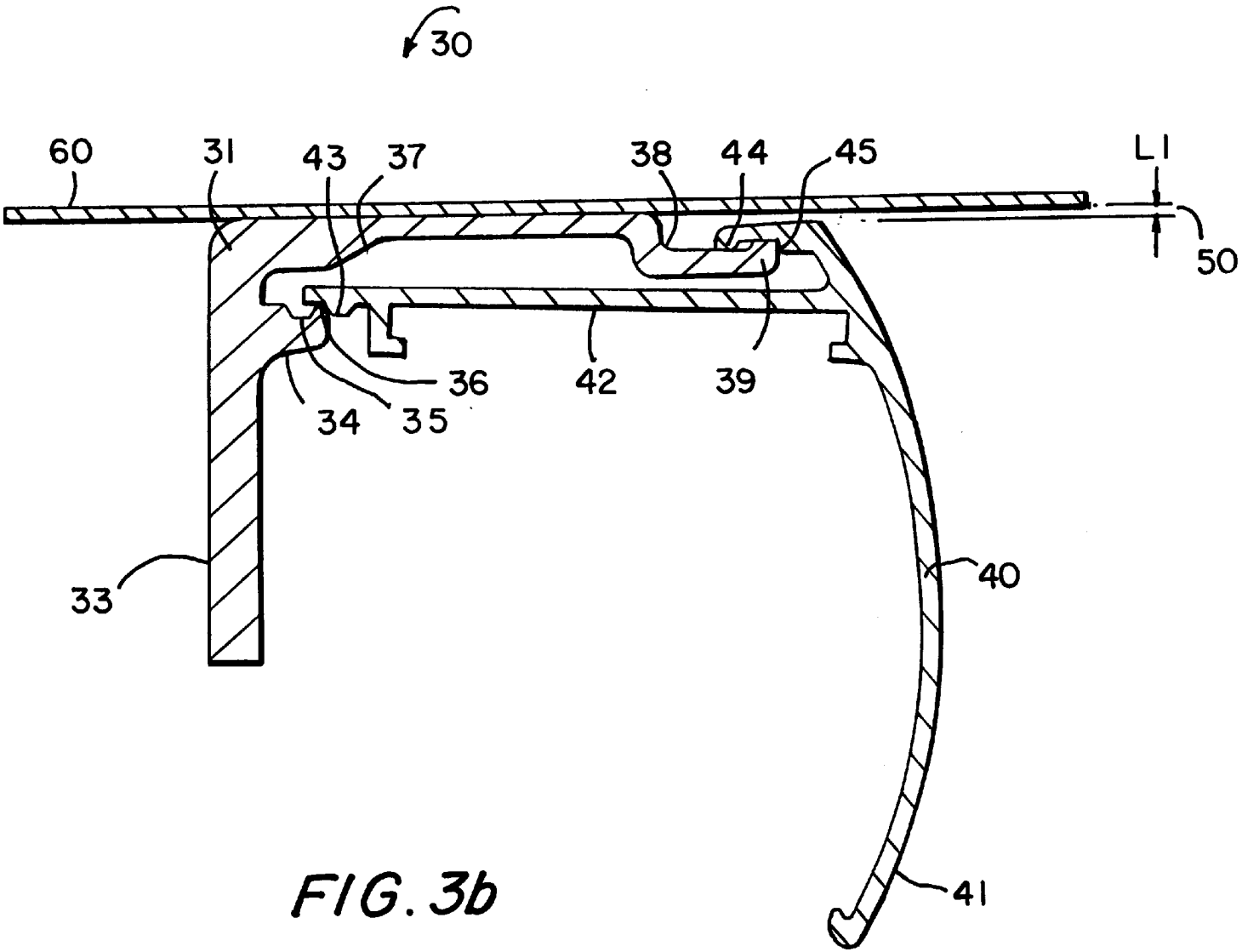
FIG. 3*b* depicts the bracket and headrail of the present invention during assembly.

FIG. 3*b* shows the bracket and headrail assembly partially engaged. As headrail 40 is moved back into bracket 31, ramp 45 of hook element 44 slides over nib element 39 formed at the end of leg member 32, thereby lifting hook element 44 of headrail 40 closer to the ceiling and reducing the size of space 50.

Figure 3C:
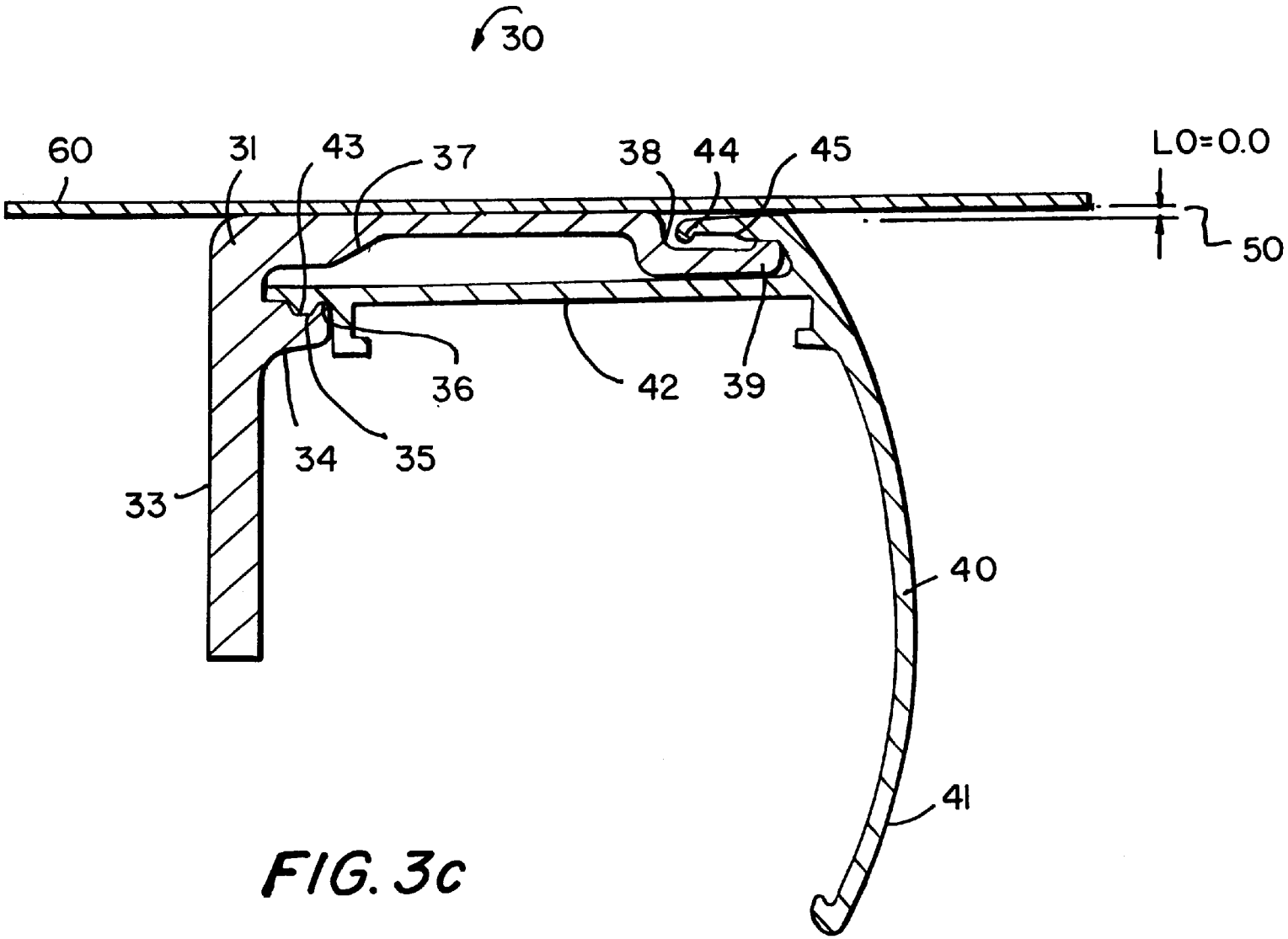
FIG. 3*c* depicts the bracket and headrail of the present invention after assembly.

In FIG. 3*c,* bracket 31 and headrail 40 are fully engaged. Ramp 45 has caused headrail 40 to abut the ceiling at the same time as headrail 40 fully engages with bracket 31 (nib 43 of horizontal member 42 is received by pocket 35 of finger 34). Space 50, as can be appreciated, has been completely eliminated, thereby preventing light from leaking through while completely hiding bracket 31 from sight. Moreover, headrail 40 is secured to the bracket 31 by nib 43 of headrail 40 resting in pocket 35 of bracket 31.

It will thus be seen that the objects set forth above, among those made apparent from the preceding description, are efficiently attained, and since certain changes may be made in the construction of the inventive window shade system without departing from the spirit and scope of the invention, it is intended that all matter contained in the above description as shown in the accompanying drawings, shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

What is claimed is:

1. A bracket and headrail system for window coverings comprising:

a bracket for mounting to or underneath a ceiling and having a vertical back member and a depending forwardly extending horizontal top leg for disposition up against a ceiling, said back member having a first engagement member; and a headrail having a front, vertical portion leading to a top end and a depending horizontal member designed to underlie said top leg of said bracket in assembly, said horizontal member of said headrail having a second engagement member for selectively engaging said first engaging member of said bracket back member during assembly of said bracket;

a ramped element for lifting the top end of said headrail vertical portion as said second engagement member engages said first engaging member.

2. The bracket and headrail system of claim 1 wherein said first engagement means includes a forwardly extending finger.

3. The bracket and headrail system of claim 2 wherein said second engagement means further comprises a kay for interlocking with said finger.

4. The bracket and headrail system of claim 3, wherein said finger includes a pocket for matingly receiving a protrusion depending from said key.

5. The bracket and headrail system of claim 1 wherein said top end of said headrail vertical portion includes a first hook element.

6. The bracket and headrail system of claim 5 wherein said top leg has a forward end with a second hook element for selectively interlocking with said first hook element.

7. The bracket and headrail system of claim 5, wherein said first hook element of said headrail vertical portion has an undersurface comprising said ramped element.

8. The bracket and headrail system of claim 7, wherein said bracket top leg includes a forward end designed for riding along said ramped element of said headrail hook element as said second engagement member of said headrail horizontal member engages said first engagement member of said bracket back member in order to controllably lift said hook element of said headrail.

9. A bracket and headrail system for window coverings comprising:

a bracket for mounting to or underneath a ceiling and having a vertical back member and a depending forwardly extending horizontal top leg for disposition up against a ceiling, said back member having a first engagement member; and a headrail having a front, vertical portion leading to a top end and a depending horizontal member designed to underlie said top leg of said bracket in assembly, said horizontal member of said headrail having a second engagement member for selectively engaging said first engaging member of said bracket back member during assembly of said bracket;

wherein said bracket is designed for lifting the top end of said headrail vertical portion as said second engagement member engages said first engaging member;

wherein said top end of said headrail vertical portion includes a first hook element with an undersurface which is ramped.

10. The bracket and headrail system of claim 9, wherein said bracket top leg includes a forward end designed for riding along said ramped undersurface of said headrail hook element as said second engagement member of said headrail horizontal member engages said first engagement member of said bracket back member in order to controllably lift said hook element of said headrail.

* * * * *